US009004630B2

(12) United States Patent
Nagatsuka et al.

(10) Patent No.: US 9,004,630 B2
(45) Date of Patent: Apr. 14, 2015

(54) INKJET PRINTING APPARATUS AND CONTROL METHOD THEREOF

(71) Applicant: Canon Kabushiki Kaisha, Tokyo (JP)

(72) Inventors: Toshikazu Nagatsuka, Tokyo (JP); Shuichi Murakami, Kawasaki (JP); Keiji Tomizawa, Yokohama (JP); Atsushi Omura, Kawasaki (JP); Etsuko Sawada, Tokyo (JP); Hiroaki Mihara, Machida (JP); Yohei Hamade, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 154 days.

(21) Appl. No.: 13/893,561

(22) Filed: May 14, 2013

(65) Prior Publication Data

US 2013/0307889 A1 Nov. 21, 2013

(30) Foreign Application Priority Data

May 21, 2012 (JP) ..... 2012-115373

(51) Int. Cl.
*B41J 29/38* (2006.01)
*B41J 2/165* (2006.01)
*B41J 2/045* (2006.01)

(52) U.S. Cl.
CPC ..... *B41J 2/04541* (2013.01); *B41J 2/0458* (2013.01); *B41J 2/16526* (2013.01); *B41J 2002/16573* (2013.01)

(58) Field of Classification Search
CPC ..... B41J 2/04598; B41J 2002/16573; B41J 2/3556
See application file for complete search history.

(56) References Cited

U.S. PATENT DOCUMENTS

| | | | | |
|---|---|---|---|---|
| 5,638,100 | A * | 6/1997 | Kanematsu et al. | 347/35 |
| 6,149,261 | A | 11/2000 | Kuwabara et al. | |
| 6,540,330 | B1 | 4/2003 | Kubota et al. | |
| 6,557,969 | B1 | 5/2003 | Murakami et al. | |
| 6,752,485 | B2 | 6/2004 | Murakami et al. | |
| 7,011,386 | B2 * | 3/2006 | Iwasaki et al. | 347/23 |

FOREIGN PATENT DOCUMENTS

JP 2001-105599 A 4/2001

* cited by examiner

*Primary Examiner* — Stephen Meier
*Assistant Examiner* — Renee I Wilson
(74) *Attorney, Agent, or Firm* — Fitzpatrick, Cella, Harper & Scinto

(57) ABSTRACT

There is provided an inkjet printing apparatus which can perform stable ejection also in successive printing at high speed even in a case of performing printing in use of a print head provided with an ejection opening surface having hydrophilic properties. The inkjet printing apparatus comprises an inkjet print head wherein the control unit controls the print head such that, in a case where the ejection number of the ink ejected from the print head after removing the ink on the ejection opening surface by the ink removal unit is equal to or more than a threshold, a drive energy amount that is supplied for the preliminary ejection operation is larger than a drive energy amount that is supplied for the preliminary ejection operation in a case where the ejection number is less than the threshold.

16 Claims, 7 Drawing Sheets

INKJET PRINTING APPARATUS AND CONTROL METHOD THEREOF

BACKGROUND OF THE INVENTION

1. Field of the Invention

The present invention relates to an inkjet printing apparatus and a control method thereof.

2. Description of the Related Art

There are some cases where a printing apparatus of an inkjet method performs processing such as water repellent treatment on a surface (hereinafter also called "ejection opening surface") on which ejection openings are provided for ejecting inks. In a case where the ink inhomogeneously adheres to the periphery of the ejection opening in the inkjet printing apparatus, in some cases at the time of ejecting inks, the ejected ink is pulled by the ink having adhered to the periphery of the ejection opening to shift an ejection direction of the ink. Therefore such treatment is performed.

In regard to the treatment to the ejection opening surface, in many cases the water repellent treatment is performed. However, recently in the environment where the function of the water repellent treatment is difficult to be sufficiently effective, such as a case of using pigment ink or high-function ink, or in the environment where a viscosity increase of ink in the ejection opening is easy to occur, such as a case of ejecting small liquid droplets, in some cases hydrophilic treatment is also performed. For example, Japanese Patent Laid-Open No. 2001-105599 discloses a print head in which such an ejection opening surface is coated with a material having super hydrophilic properties, thus performing the hydrophilic treatment thereon.

In such an ejection opening surface having hydrophilic properties, the ink of a thin-film exists across the entire ejection opening surface. Therefore, a difference in wet properties between the adhered ink and the hydrophilic surface is difficult to occur, and since the sufficient ink exists on the ejection opening surface, the ink in the ejection opening is difficult to dry.

Incidentally, recently the inkjet print head aims for imaging with higher quality and higher speeding in printing. Therefore an arrangement density of the ejection openings is becoming very high, for example, 600 dpi to meet conditions of small-liquid droplet formation and high-frequency drive.

As ink is ejected by the print head in which the arrangement density of the ejection openings is high and which has the ejection opening surface of the hydrophilic properties, the ink that has spread out across the entire ejection opening surface remains in the periphery of the ejection opening to overflow, and the ink accumulates in the periphery of the ejection opening. As a result, the ink in the periphery of the ejection opening blocks the ejection opening in some point of time, in some cases non-ejection of the ink is generated during the printing. As the non-ejection is generated during the printing, an image defect is possibly generated in a case where the ink of s single color is in use, and unevenness in density is possibly generated in an image in a case where inks of plural colors are in use.

SUMMARY OF THE INVENTION

The present invention is made in view of the foregoing problems, and an object of the present invention is to provide an inkjet printing apparatus and a control method thereof which can perform stable ejection also in successive printing at high speed even in a case of performing printing in use of a print head provided with an ejection opening surface having hydrophilic properties.

Therefore an inkjet printing apparatus according to the present invention comprises: an inkjet printing apparatus comprising: an inkjet print head including at least one of print elements for ejecting ink droplets from ejection opening by supply of drive energy thereto, and an ejection opening surface, on which the ejection opening are provided, having hydrophilic properties; an ink removal unit configured to remove inks on the ejection opening surface; and a control unit configured to control the print head to perform a preliminary ejection operation for ejecting ink droplets contributed by printing, wherein the control unit controls the print head such that, in a case where the ejection number of ink ejected from the print head after removing the ink on the ejection opening surface by the ink removal unit is equal to or more than a threshold, a drive energy amount that is supplied to the print element for the preliminary ejection operation is larger than a drive energy amount that is supplied to the print element for the preliminary ejection operation in a case where the ejection number of the ink is less than the threshold.

According to the aforementioned configuration, at the time there is a possibility that the ink overflowing on the ejection opening surface interrupts the ejection of the ink droplet, the clogging of the ejection opening can be prevented by increasing the intensity of the preliminary ejection. Thereby also in a case of performing printing by using the print head provided with the ejection opening surface having the hydrophilic properties, the stable ejection can be performed also in successive printing at high speed.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the accompanying drawings.

(First Embodiment)

Figure 1:
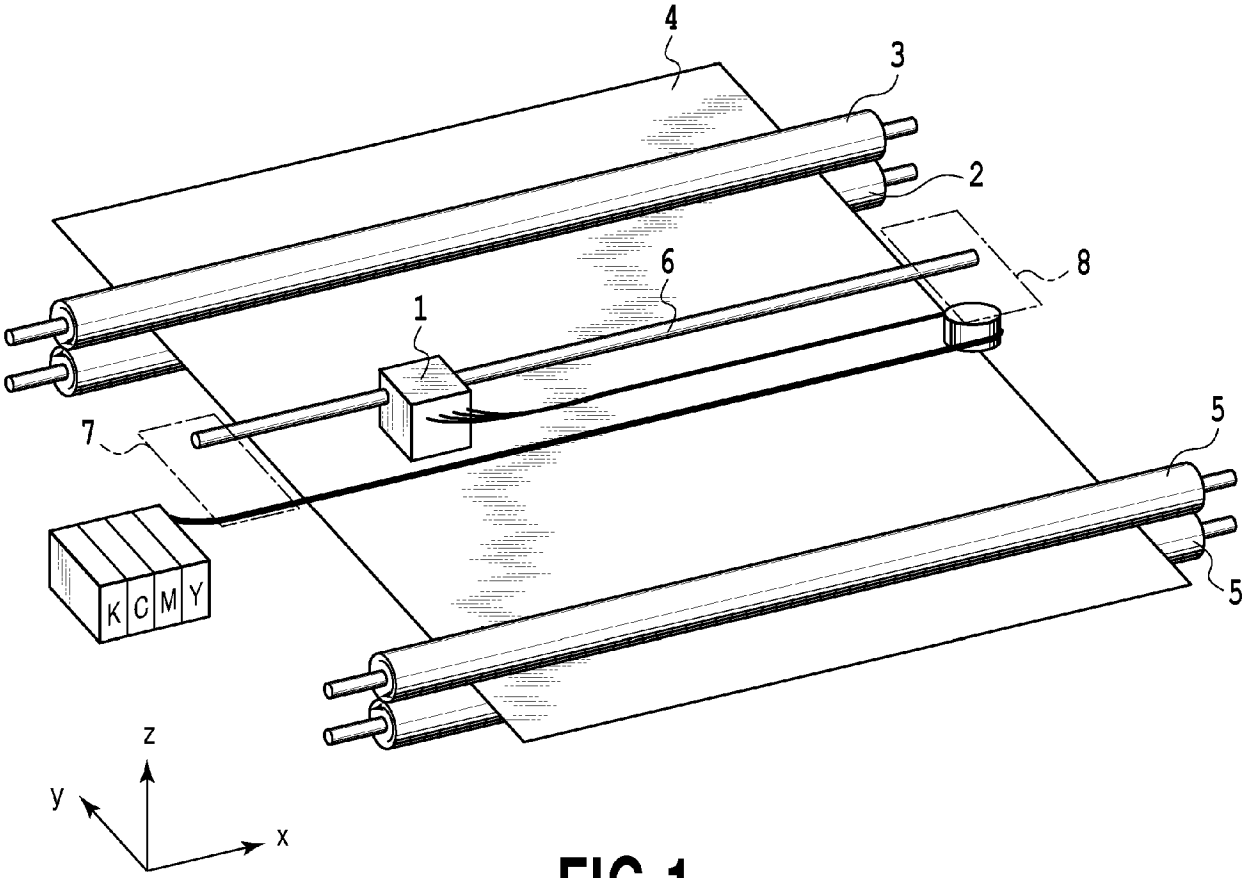
FIG. 1 is a perspective view showing a primary part of an inkjet print apparatus according to a first embodiment.

FIG. 1 is a perspective view showing a primary part of an inkjet printing apparatus according to the present embodiment. A print head 1 removably mounted on the inkjet printing apparatus is provided with ink tanks separated therefrom, and forms an image by inks supplied through tubes or the like from the ink tanks. The ink head 1 is provided with ink supply portions in accordance with kinds of inks, and is provided with individual liquid chambers therein, each of which is formed for each ink in such a manner that the inks are not blended with each other in the print head 1.

A print medium 4 that is supplied by paper conveying rollers 5 is conveyed in a y direction while being tightly sandwiched by a paper conveying roller 2 and an auxiliary roller 3 each rotating in an arrow direction shown in the figure. The pair of paper conveying rollers 5 tightly holds the print medium 4 therebetween while rotating, and as a rotation speed thereof is made smaller than that of the paper conveying roller 2, can effect tension to the print medium 4.

A carriage holds the print head 1, scans the print medium from one end toward the other end along a guide rail 6, and ejects inks from the print head 1 to perform printing on the print medium 4. As the carriage reaches the other end of the print medium 4, the paper conveying roller 2 and the like rotate to convey the print medium 4 by a constant amount. The printing operation and the paper conveying operation are alternately repeated, and thereby an image is formed on an entire print medium.

The carriage moves to a home position 7 in a position shown in a broken line in the figure and stops therein at the time of not performing the printing, at the time of performing recovery processing (suction operation of ink at the ejection opening or ink removal by wiping an ejection opening surface) of the print head 1 or the like. The recovery processing herein indicates removal of adhesion ink, dusts, dirt and the like on the surface of the ejection opening by a member such as a wiper blade.

In a case of an inkjet printing system by heater elements, in the environment of a low temperature and a low humidity, an ejection amount of ink is reduced by an ink viscosity increase due to the low temperature and ink evaporation due to the low humidity, and as a result, ejection stability of non-use nozzles is deteriorated. Particularly since the printing stability at a start of print writing is deteriorated, a preliminary ejection operation as ejection of ink not used for printing immediately prior to the printing is performed. It should be noted that in a case of performing interactive printing for realizing high-speed printing, the preliminary ejection location corresponds to the hole position 7 and an area 8 positioned at the opposite to the home position 7 in the carriage scan direction.

Figure 2:
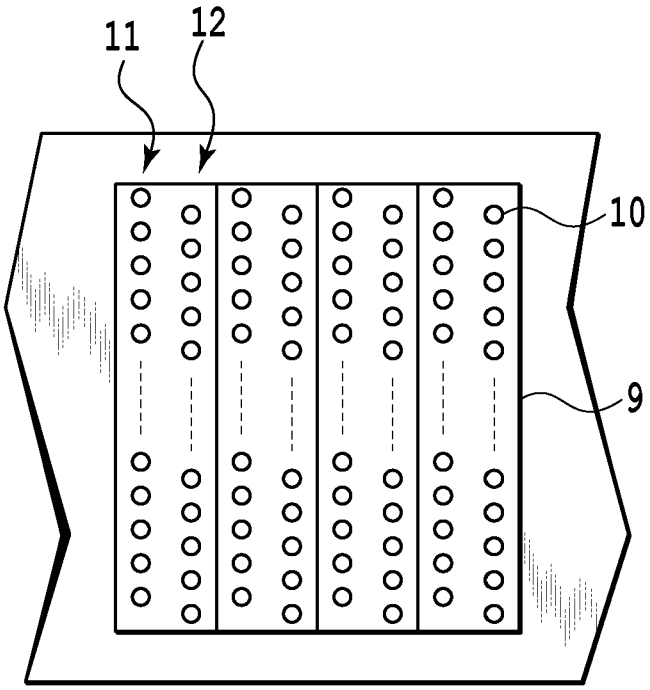
FIG. 2 is a schematic diagram showing an ejection opening surface of a print head in the first embodiment.

FIG. 2 is a schematic diagram showing an ejection opening surface of the print head in the present embodiment. Ink is supplied to a chip 9 of each color from a liquid chamber for the ink of each color provided in the print head 1. In the print head 1, ejection openings 10 (hereinafter called "nozzles") for each color are arranged in parallel with the scan direction of the carriage on the surface opposing the print medium. In the present embodiment, in the nozzles in a first nozzle row 11 and a second nozzle row 12 where a plurality of ejection openings 10 are arranged, each nozzle interval between the neighbored nozzles is 600 dpi. The nozzles in the first nozzle row 11 are arranged to the nozzles in the second nozzle row 12 in such a manner that each pitch between the neighbored nozzles in the second nozzle row 12 deviates by a half pitch from each pitch between the neighbored nozzles in the first nozzle row 11. These nozzle rows are arranged in parallel with the scan direction of the carriage. The print head in the present embodiment has the nozzle row of each color having a nozzle pitch of approximately 42.3 μm, and has 1280 nozzles in a combination of those in the first nozzle row and the second nozzle row. An ejection opening diameter of each nozzle has 14.3 μm, and an ejection amount thereof has 4.5 ng. In addition, inks in use include four colors of black, cyan, magenta and yellow.

Each nozzle is communicated through the tube and the ink flow passage to the ink tank, and the surroundings of the ejection opening are regularly filled with ink by supply of the ink from the ink tank. In addition, each nozzle is provided with a heater element, which provides thermal energy to the ink. The ink is subjected to heat by the heater element to form air bubbles due to film boiling, and kinetic energy is given to the ink by air-bubble pressures due to the air bubble, and thereby the ink is ejected from the ejection opening 10.

The surface (ejection opening surface) of the chip 10 opposing the print medium in the present embodiment has high hydrophilic properties. This is because contaminations due to the liquid attached on the surface do not form liquid droplets and spread out as a thin film on the entire surface, which suppresses formation of solidified particles. Therefore it is difficult for the solidified particle to close the ejection opening, and the print head can maintain excellent performance for a long period of time. It should be noted that for forming highly hydrophilic properties onto the ejection opening surface, only the surface of the ejection opening forming member may be coated with a material having highly hydrophilic properties or there may be employed a method of enhancing the hydrophilic properties by performing physical treatment only on the surface of the ejection opening forming member. Further, the ejection opening forming member itself may be configured of a highly hydrophilic material. That is, the ejection opening surface in the present embodiment is only required to be an ejection opening surface having hydrophilic characteristics by any method. In the present embodiment, "ejection opening surface having hydrophilic properties" shows a state where the ink spreads out widely on the ejection opening surface to be wet. As a state of the ejection opening surface at this time, an evaporation dynamic contact angle (environmental temperature of 25° C. and humidity of 65%) by pure water has preferably 70 degrees or less, more preferably 40 degrees or less.

Figure 3:
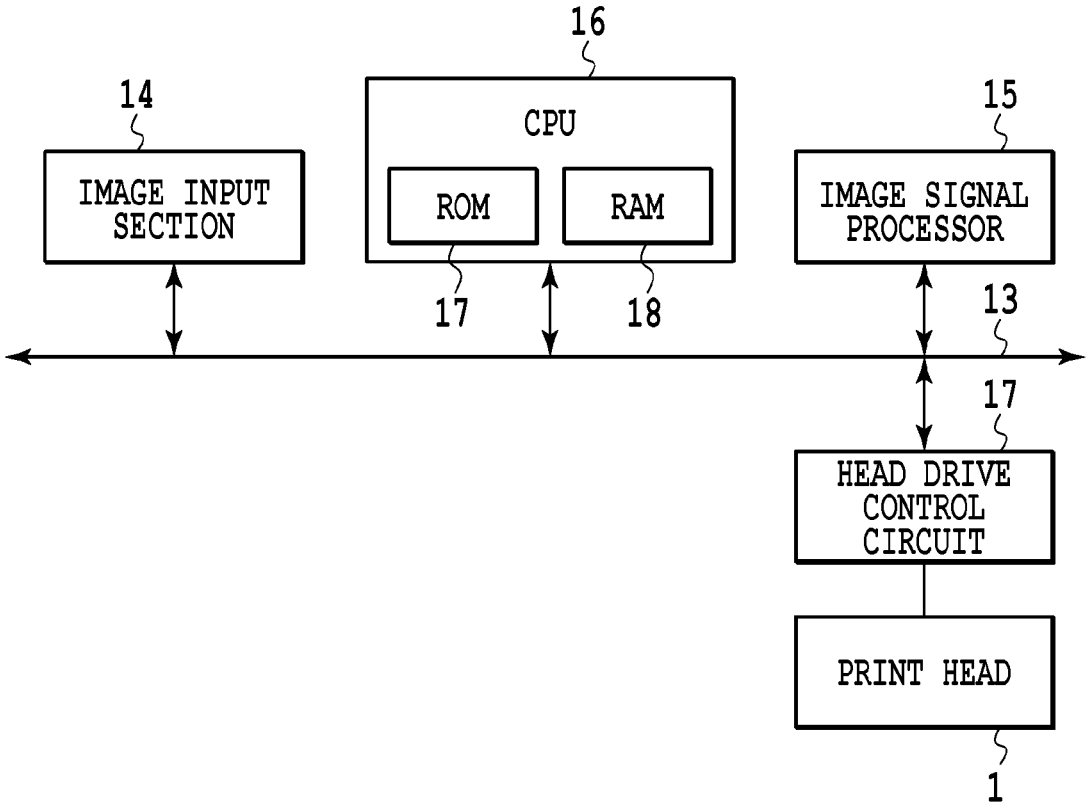
FIG. 3 is a block diagram showing the configuration of a control system of the printing apparatus according to the first embodiment.

FIG. 3 is a block diagram showing the configuration of a control system in the inkjet printing apparatus in the present embodiment. A main bus line 13 is connected to an image input section 14, an image signal processor 15, a CPU 16 as a central processor unit, and a head drive control circuit 17 to be accessible respectively thereto. An ejection pattern for preliminary ejection, that will be described later, is generated in the image signal processor 15. An image input from the image input section 14 is subjected to software processing by the CPU 16 and the mage signal processor 15 and is subjected to hardware processing matching up to the inkjet print head by the head drive control circuit 17. The CPU 16 regularly includes a ROM 17 and a random access memory (RAM) 18, and provides an appropriate print condition to input information to drive the print head 1, thus performing printing. In addition, a program is in advance stored in the ROM 17 for performing a preliminary ejection sequence that will be in detail described hereinafter. The head drive control circuit 17 performs drive control of a heater as a heater element for ejecting ink from the print head 1. Examples of the kind of the ejection include ejection for regular printing, general preliminary ejection, and further, preliminary ejection that will be in detail described hereinafter.

In the present embodiment, the control of the preliminary ejection during printing is designed to vary. That is, in the present embodiment, in a case where a total ejection number from a printing start by the ejection opening subjected to the recovery processing of the ejection opening at the previous printing finish time or from a point after the preliminary ejection in the middle of printing reaches a constant threshold or more, a drive pulse width for drive control of the preliminary ejection is made longer. Hereinafter, an explanation will be in detail made of the preliminary ejection control in the present embodiment.

Figure 4:
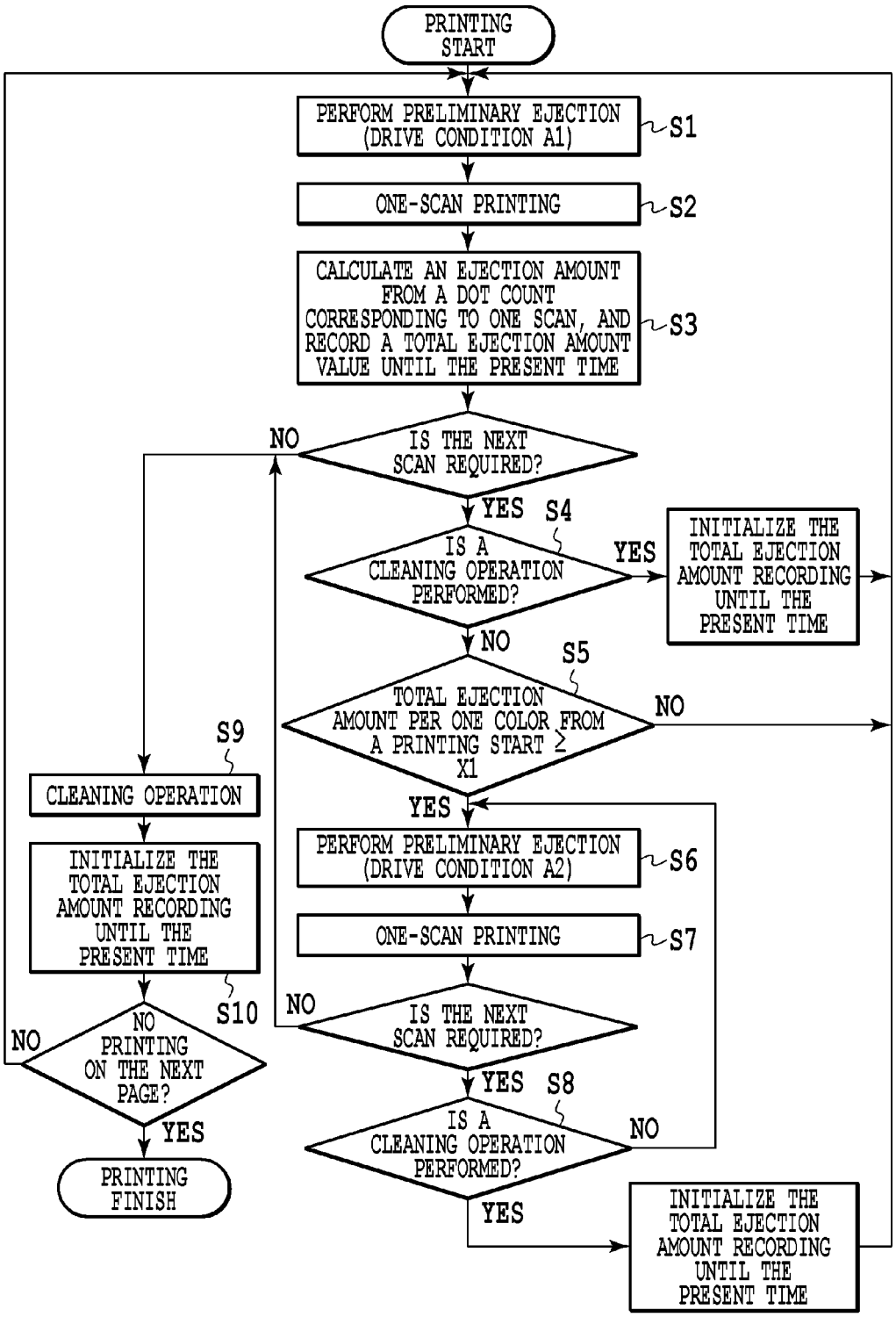
FIG. 4 is a flow chart showing a print operation of the printing apparatus according to the first embodiment.

FIG. 4 is a flow chart showing a printing operation of the printing apparatus in the present embodiment. When an input signal of an image is sent from the CPU 16, printing is started. When the printing is started, the preliminary ejection is performed (step S1). The drive condition at this time is condition A shown in Table 1.

TABLE 1 a Preliminary Ejection Drive Condition in the First Embodiment

| Drive Condition | A1 | A2 |
|---|---|---|
| Drive Voltage | 24 V | 24 V |
| Drive Frequency | 1 kHz | 1 kHz |
| Drive Number | 10 Times | 10 Times |
| Pulse Width | P1 (0.60 μs) | P2 (0.74 μs) |

Next, one-scan printing is performed (step S2). Then, the ejection number is calculated from the dot count ejected by the previous scan, and the total ejection number until the present time is recorded in the RAM 18 in the printing apparatus (step S3). After that, it is determined whether or not the next scan is required. When the recovery processing is input (step S4) in a case where the next scan is required, since the ink accumulated on the ejection opening surface is removed, the total ejection number having been recorded in the RAM until the present time is initialized, and the process goes back to step S1. On the other hand, in a case where the recovery processing is not input, the total ejection number in advance recorded in the RAM 18 in the printing apparatus is compared with a total ejection number threshold X1 (e.g. X1=40 million ejections) in regard to a change of a preliminary ejection drive condition (step S5). In a case where the total ejection number is less than X1, the process goes back to step S1.

On the other hand, in a case where the total ejection number is X1 or more, the ink accumulates on the ejection opening surface and overflows thereon to interrupt the ejection of the ink, possibly creating non-ejection of the ink.

Figure 5:
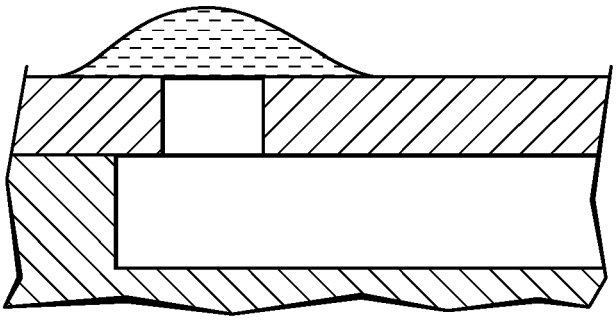
FIG. 5 is a schematic diagram showing a state of non-ejection of ink.

FIG. 5 is a schematic diagram showing a state where the ink is ejected by the ejection number of X1 or more using the print head the ejection opening surface of which is subjected to the hydrophilic treatment. As shown in the figure, the ink overflows on the ejection opening surface to block the ejection opening. Therefore the preliminary ejection is performed on drive condition A2 shown in Table 1 to increase the ejection intensity, which prevents the ink having accumulated on the ejection opening surface from interrupting the ejection (step S6). In the present embodiment, a difference between drive condition A1 and drive condition A2 in Table 1 is a pulse width. A relation of P1<P2 (P1=0.60 μs, and P2=0.74 μs) is set, and there is provided the sequence of increasing input energy given to the ink by the heater element.

Referring back to FIG. 4, when the preliminary ejection is finished (step S6), one-scan printing is performed (step S7). When the scan is further required and the recovery processing is not performed (step S8), the process goes back to step S6, wherein the preliminary ejection on drive condition A2 is performed (step S6), and one-scan printing is performed (step S7).

On the other hand, when the recovery processing is performed (step S8), the total ejection number having been recorded in the RAM until the present time is initialized, and the process goes back to step S1.

In a case where the next scan is not required after step S3 or step S7 is finished, the recovery processing is performed (step S9). Therefore the print head 1 returns to the home position 7. In addition, the total ejection number having been recorded in the RAM until the present time is initialized (step S10). In a case where printing of the next page is required, the process goes back to the previous printing start step, wherein the printing and the preliminary ejection are again performed.

As described above, in the present embodiment, when the total ejection number from a point of the printing start in a state where the recovery processing on the ejection opening surface is performed at the previous printing finish or from a point after the recovery processing is performed at some midpoint of printing is equal to or more than a constant threshold, the drive control of the preliminary ejection is changed from condition A1 to condition A2 for lengthening the pulse width.

It should be noted that the total ejection number threshold X1 in the present embodiment is defined as 40 million ejections, but in the present invention, the total ejection number threshold is not limited to the above ejection number. That is, based upon the density of the ejection openings, the viscosity of the ink, the environmental temperature and humidity of the inkjet printing apparatus, and the like, the threshold may be defined by the ejection number by which the ink accumulated on the ejection opening surface overflows to interrupt the ejection of the ink from the ejection opening.

Figure 6:
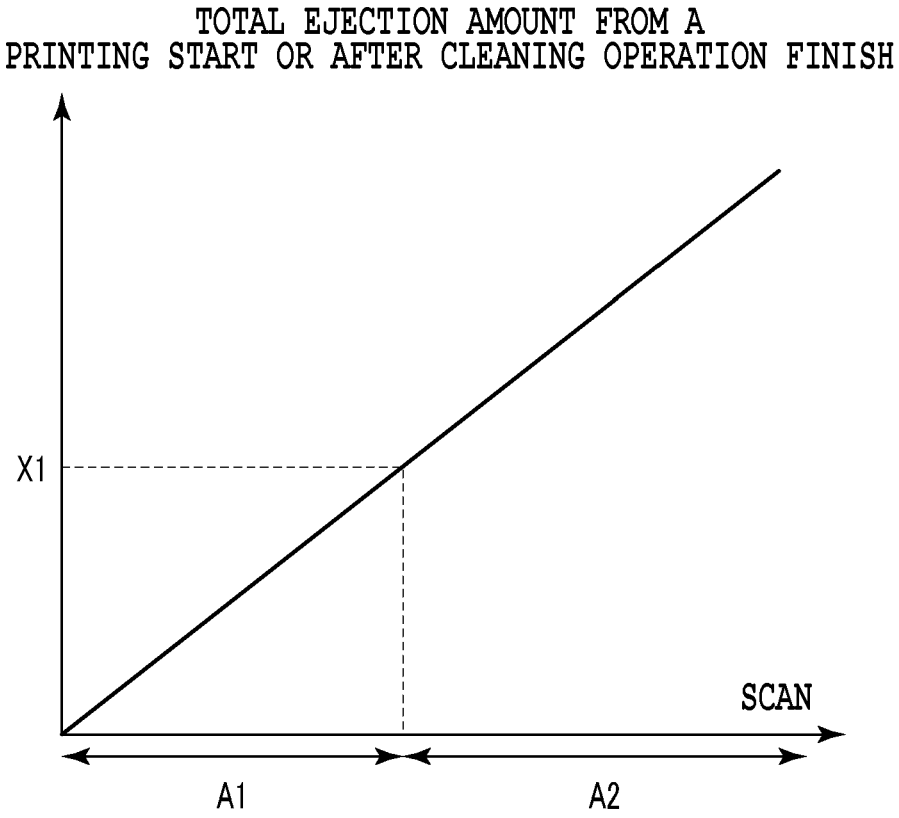
FIG. 6 is a graph showing a relation between a total ejection number and a drive condition in the first embodiment.

FIG. 6 is a graph showing a relation between the total ejection number and the drive condition in the present embodiment. A lateral axis shows the condition and a vertical axis shows the total ejection number from the printing start or the recovery processing finish. An ejection defect of each scan at the printing start is caused by an amount of ink overflow immediately before each scan for printing. Since a total amount of the ink overflow is in proportion to the total ejection number in a case of high-duty printing, it is desirable to change the preliminary ejection condition to a threshold of the total ejection number as shown in FIG. 6 or more. That is, swing of the overflow ink caused by the preliminary ejection on drive condition A1 can not suppress the ejection defect, but when the input energy of the heater element is increased as shown on drive condition A2, it is possible to further swing the overflow ink and eject the ink normally. In addition, by setting drive condition A2 as the preliminary ejection condition from the beginning and not adopting a method of performing the preliminary ejection at highly sufficient input energy, it is possible to improve the energy saving and durability of the heater element.

(Second Embodiment)

In the first embodiment, when the total ejection number from the printing start or the recovery processing reaches a constant threshold or more, the pulse width in the drive control of the preliminary ejection is made longer to suppress the non-ejection of the ink. However, the present invention is not limited to the first embodiment where when the total ejection number from the printing start or the recovery processing reaches a constant threshold or more, the pulse width in the drive control of the preliminary ejection is changed.

The drive control of the preliminary ejection in the present embodiment is configured to change a drive voltage therein when the total ejection number from the printing start or the recovery processing reaches a constant threshold or more.

The inkjet printing apparatus and the print head in the present embodiment have the same configuration as the printing apparatus and the print head in the first embodiment.

In the present embodiment, when the total ejection number of ink droplets from the printing start is less than the total ejection number threshold X1 (X1=40 million ejections), the preliminary ejection is performed based on a condition of condition A1 shown in Table 2.

TABLE 2 a Preliminary Ejection Drive Condition in the Second Embodiment

| Drive Condition | A1 V1 | A2 V2 |
|---|---|---|
| Drive Voltage | 24.0 V | 26.7 V |
| Drive Frequency | 1 kHz | 1 kHz |
| Drive Number | 10 Times | 10 Times |
| Pulse Width | 0.60 μs | 0.60 μs |

On the other hand, when the total ejection number of ink droplets is equal to or more than the total ejection number threshold X1 (X1=40 million ejections), the preliminary ejection is performed based on a condition of condition A2 shown in Table 2. In the present embodiment, a difference between drive condition A1 and drive condition A2 is a drive voltage. A relation of V1<V2 (V1=24.0V, and V2=26.7V) is set, and there is adopted the sequence of increasing input energy given to the ink by the heater element.

(Third Embodiment)

The drive control of the preliminary ejection in the present embodiment is configured to change a drive frequency therein when the total ejection number from the printing start or the recovery processing reaches a constant threshold or more.

The inkjet printing apparatus and the print head in the present embodiment have the same configuration as the printing apparatus and the print head in the first embodiment.

In the present embodiment, when the total ejection number of ink droplets from the printing start is less than the total ejection number threshold X1 (X1=40 million ejections), the preliminary ejection is performed based on a condition of condition A1 shown in Table 3.

TABLE 3 a Preliminary Ejection Drive Condition in the Third Embodiment

| Drive Condition | A1 | A2 |
|---|---|---|
| Drive Voltage | 24.0 V | 24.0 V |
| Drive Frequency | F1 (1 kHz) | f2 (10 kHz) |
| Drive Time | 0.01 s | 0.01 s |
| Pulse Width | 0.60 μs | 0.60 μs |

On the other hand, when the total ejection number of ink droplets is equal to or more than the total ejection number threshold X1 (X1=40 million ejections), the preliminary ejection is performed based on a condition of condition A2 shown in Table 2. In the present embodiment, a difference between drive condition A1 and drive condition A2 is a drive frequency. A relation of f1<f2 (f1=1 kHz, and f2=10 kHz) is set, and the drive time of the preliminary ejection is the same therebetween, but there is adopted the sequence of increasing the drive number by increasing the frequency.

(Fourth Embodiment)

In the first to third embodiments, in a case where the total ejection number of ink droplets from the printing start or the recovery processing is equal to or more than the threshold, the drive control of the preliminary ejection is changed. However, the present invention, even if the total ejection number of ink droplets from the printing start or the recovery processing is equal to or more than the threshold, may include an embodiment of not changing the drive control of the preliminary ejection depending on a color of ink.

The print head in the present embodiment is a print head for ejecting inks of four colors of black, cyan, magenta, and yellow. In regard to black ink and yellow ink among these inks, the ink as much as affecting the printing does not overflow in the printing environment of high duty. Therefore even if the total ejection number of ink droplets of each of the black ink and the yellow ink reaches the threshold or more, it is not required to change the drive control of the preliminary ejection.

In this way, in a case where there is present ink in which an amount of the overflow ink is small, the energy saving and the durability of the heater element can be further improved by not increasing the drive energy or the drive number per unit time.

(Fifth Embodiment)

In the aforementioned embodiment, the single threshold for changing the drive control of the preliminary ejection is provided, and two conditions of the drive control of the preliminary ejection are prepared. The present invention, however, may be an embodiment in which a plurality of thresholds are provided, wherein each time the total ejection number of ink droplets exceeds each of the thresholds, the drive control of the preliminary ejection is in a step-by-step manner changed to perform the drive control with a more optimal drive condition of the preliminary ejection. The energy saving and the durability of the heater element can be further improved by thus changing the drive condition in a step-by-step manner.

In the present embodiment, three thresholds, that is, X1=40 million ejections, X2=48 million ejections and X3=56 million ejections are set. In addition, since the drive condition of the preliminary ejection can be changed for each scan, the drive condition may be changed in a step-by-step manner by the scan number within one-paper printing. In a case where the drive condition is divided into four steps from A1 to A4, the preliminary ejection is performed on condition A1 in a case where the total ejection number is less than X1, on condition A2 in a case where the total ejection number is equal to or more than X1, on condition A3 in a case where the total ejection number is equal to or more than X2, and on condition A4 in a case where the total ejection number is equal to or more than X3. In a case of changing the pulse width from condition A1 to condition A4, a relation of P1<P2<P3<P4 (P1=0.6 μs, P2=0.65 μs, P3=0.69 μs, and P4=0.74 μs) is set. In addition, in a case of changing the drive voltage, a relation of V1<V2<V3<V4 (V1=24.0V, V2=24.9V, V3=25.8V, and V4=26.7V) is set. In addition, in a case of changing the drive frequency, a relation of f1<f2<f3<f4 (f1=1 kHz, f2=4 kHz, f3=7 kHz, and f4=10 kHz) is set. The energy saving and the durability of the heater element can be further improved by thus changing the condition in a step-by-step manner.

In addition, the threshold may be determined by the ejection number for increasing the ejection intensity in order to suppress interruption of ejection of ink due to an overflow amount of inks accumulated on the ejection opening surface, and may be determined based upon the density of the ejection opening, the viscosity of the ink, the environmental temperature and humidity of the inkjet printing apparatus, and the like.

Figure 7:
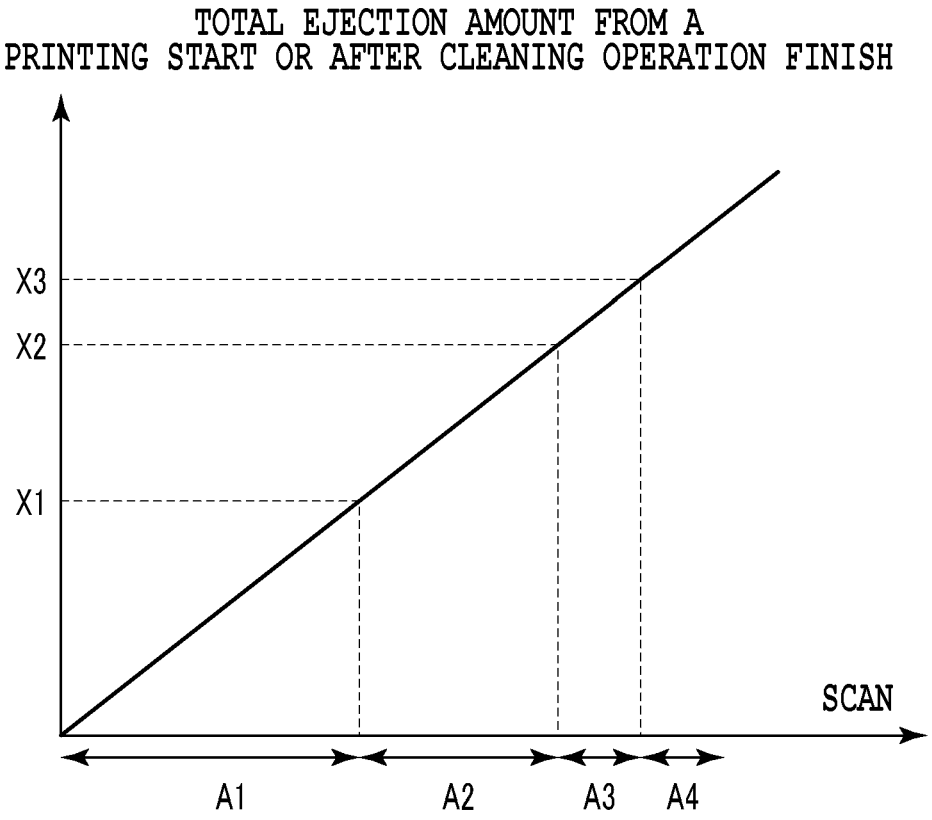
FIG. 7 is a graph showing a relation between a total ejection number and a drive condition in a fifth first embodiment.

FIG. 7 is a graph showing a relation between the total ejection number and the drive condition in the present embodiment. A lateral axis shows the condition and a vertical axis shows the total ejection number from the printing start or the recovery processing finish.

It is should be noted that in the present embodiment, three thresholds are provided, but the number of the threshold may be any number as long as it is one or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-115373, filed May 21, 2012, which is hereby incorporated by reference herein in its entirety.

What is claimed is:

1. An inkjet printing apparatus comprising:

an inkjet print head including at least one of print elements for ejecting ink droplets from ejection opening by supply of drive energy thereto, and an ejection opening surface, on which the ejection opening are provided, having hydrophilic properties;

an ink removal unit configured to remove inks on the ejection opening surface; and a control unit configured to control the print head to perform a preliminary ejection operation for ejecting ink droplets contributed by printing, wherein the control unit controls the print head such that, in a case where the ejection number of ink ejected from the print head after removing the ink on the ejection opening surface by the ink removal unit is equal to or more than a threshold, a drive energy amount that is supplied to the print element for the preliminary ejection operation is larger than a drive energy amount that is supplied to the print element for the preliminary ejection operation in a case where the ejection number of the ink is less than the threshold.

2. An inkjet printing apparatus according to claim 1, wherein the control unit adjusts one of a drive pulse width, a drive voltage, and a drive frequency to control the drive energy amount that is supplied to the print element.

3. An inkjet printing apparatus according to claim 1, wherein the control unit changes the drive energy in a step-by-step manner.

4. An inkjet printing apparatus according to claim 1, wherein the ejection opening surface is coated with a material having hydrophilic properties.

5. An inkjet printing apparatus according to claim 1, wherein an evaporation dynamic contact angle of the ejection opening surface to pure water is equal to or less than 70 degrees.

6. An inkjet printing apparatus according to claim 1, wherein the ink removal unit includes a wiper blade for wiping out the ejection opening surface.

7. An inkjet printing apparatus according to claim 1, further comprising:

a storing unit configured to store the ejection number, wherein the ejection number stored in the storing unit is reset in a case where the ink removal operation of ink is performed by the ink removal unit.

8. An inkjet printing apparatus according to claim 1, further comprising:

an adjusting unit configured to adjust the threshold based upon an environmental temperature and humidity of the inkjet printing apparatus.

9. A control method of an inkjet printing apparatus comprising an inkjet print head including at least one of print elements for ejecting ink droplets from ejection opening by supply of drive energy thereto, and an ejection opening surface, on which the ejection openings are provided, having hydrophilic properties, and an ink removal unit configured to remove ink on the ejection opening surface, the method comprising:

a removal step for removing the ink on the ejection opening surface by the ink removal unit;

an obtaining step for obtaining the ejection number of ejecting the ink from the print head after the removal step; and a control step for controlling the print head to perform a preliminary ejection operation for ejecting the ink droplets contributed by printing, wherein the control step controls the print head such that, in a case where the ejection number obtained at the obtaining step is equal to or more than a threshold, a drive energy amount that is supplied to the print element for the preliminary ejection operation is larger than a drive energy amount that is supplied to the print element for the preliminary ejection operation in a case where the ejection number obtained at the obtaining step is less than the threshold.

10. A control method of an inkjet printing apparatus according to claim 9, wherein the control step adjusts one of a drive pulse width, a drive voltage, and a drive frequency to control the drive energy amount that is supplied to the print element.

11. A control method of an inkjet printing apparatus according to claim 9, wherein the control step controls the drive energy amount that is supplied to the print element to change in a step-by-step manner.

12. A control method of an inkjet printing apparatus according to claim 9, wherein the ejection opening surface is coated with a material having hydrophilic properties.

13. A control method of an inkjet printing apparatus according to claim 9, wherein an evaporation dynamic contact angle of the ejection opening surface to pure water is equal to or less than 70 degrees.

14. A control method of an inkjet printing apparatus according to claim 9, wherein the ink removal unit includes a wiper blade for wiping out the ejection opening surface.

15. A control method of an inkjet printing apparatus according to claim 9, wherein the inkjet printing apparatus comprises a storing unit configured to store the ejection number, the control method further comprising:

a step for resetting the ejection number stored in the storing unit after the ink removal operation of the ink is performed by the ink removal step.

16. A control method of an inkjet printing apparatus according to claim 9, further comprising:

an adjusting step for adjusting the threshold based upon an environmental temperature and humidity of the inkjet printing apparatus.

* * * * *